US010170255B1

(12) United States Patent
Glaser

(10) Patent No.: US 10,170,255 B1
(45) Date of Patent: Jan. 1, 2019

(54) VACUUM CAPACITOR SWITCH WITH PRE-INSERTION CONTACT

(71) Applicant: Michael D. Glaser, Brookfield, WI (US)

(72) Inventor: Michael D. Glaser, Brookfield, WI (US)

( * ) Notice: Subject to any disclaimer, the term of this patent is extended or adjusted under 35 U.S.C. 154(b) by 0 days.

(21) Appl. No.: 16/018,196

(22) Filed: Jun. 26, 2018

(51) Int. Cl.
*H01H 33/16* (2006.01)
*H01H 33/666* (2006.01)

(52) U.S. Cl.
CPC ..... *H01H 33/168* (2013.01); *H01H 33/666* (2013.01)

(58) Field of Classification Search
CPC ..... H01H 33/168; H01H 33/16; H01H 33/42
USPC ..... 218/143–146, 134, 140; 200/144 AP
See application file for complete search history.

(56) References Cited

U.S. PATENT DOCUMENTS

| | | | | |
|---|---|---|---|---|
| 2,863,026 | A | 12/1958 | Jennings | |
| 3,566,061 | A | 2/1971 | Bernatt | |
| 3,576,414 | A | 4/1971 | Mikos | |
| 3,588,406 | A | 6/1971 | Bernatt | |
| 3,590,186 | A | 6/1971 | Brunner | |
| 3,763,340 | A | 10/1973 | Noack | |
| 4,069,406 | A | 1/1978 | Meinders | |
| 4,072,836 | A | 2/1978 | Bischofberger et al. | |
| 4,324,959 | A | 4/1982 | Hall et al. | |
| 4,383,150 | A | 5/1983 | Cromer et al. | |
| 4,434,332 | A * | 2/1984 | Yanabu | H01H 33/143 218/144 |
| 4,500,762 | A * | 2/1985 | Yoshizumi | H01H 33/24 218/12 |
| 4,695,918 | A | 9/1987 | O'Leary | |
| 4,788,390 | A * | 11/1988 | Crino | H01H 33/16 218/143 |
| 5,917,167 | A | 6/1999 | Bestel | |
| 6,255,615 | B1 | 7/2001 | Kimblin | |
| 6,720,515 | B2 | 4/2004 | Renz et al. | |
| 6,921,989 | B2 | 7/2005 | Baranowski et al. | |
| 8,445,805 | B2 | 5/2013 | Glaser | |
| 2008/0245772 | A1 | 10/2008 | Anger et al. | |
| 2014/0158665 | A1 * | 6/2014 | McCord | H01H 33/168 218/143 |

* cited by examiner

*Primary Examiner* — Edwin A. Leon
*Assistant Examiner* — William A Bolton
(74) *Attorney, Agent, or Firm* — Donald J. Ersler

(57) ABSTRACT

A vacuum capacitor switch with pre-insertion contact includes first and second contact systems. The first contact system includes an annular stationary contact and an annular moving contact retained on a moving contact drive rod. A second contact system includes a moving contact retained on an end of the moving contact drive rod and a floating contact retained along the same axis as the second moving contact. Both contact systems are enclosed in a vacuum envelope. A mechanical adjustment system is provided for the floating contact, which allows it to be positioned so that the secondary moving contact and floating moving contact may engage at a set interval before the annular moving contact engages the annular stationary contact. A resistor or inductor is connected between the second contact system and a load to prevent a current in-rush into the load.

19 Claims, 3 Drawing Sheets

VACUUM CAPACITOR SWITCH WITH PRE-INSERTION CONTACT

BACKGROUND OF THE INVENTION

1. Field of the Invention

The present invention relates to the field of high voltage vacuum switches and circuit interrupting devices and more particularly to a vacuum capacitor switch with a pre-insertion resistor or inductor arrangement to limit transient in-rush currents and or voltage transients during the closing and opening of a power distribution circuit containing capacitor banks.

2. Discussion of the Prior Art

A number of vacuum and non-vacuum prior art arrangements are directed to pre-insertion resistors or inductors for circuit interrupting devices wherein a resistor or inductor is either inserted in series with a high voltage switch or in parallel with a switch gap during the closing movement of the switch or interrupting unit to reduce audible and electrical noise and to limit transient in-rush current and/or voltages incident to completion of the circuit by the switch or interrupting unit. For example pre-insertion resistors of this type are shown in the following U.S. Pat. Nos. 3,588,406; 3,576,414; 3,566,061; 3,590,186; 3,763,340; 4,069,406; 4,072,836; 4,324,959; 4,695,918 and 4,788,390. Without the pre-insertion resistor, as the circuit interrupting device is closed, the in-rush current may reach values of 10 to 30 thousand amperes, where the interrupting device is used in conjunction with back to back capacitor banks. Additionally, during energization of a single capacitor bank, large voltage transients may also be produced. Such transient current and/or voltages can produce undesirable noise both audible and electrical and can, of course, also lead to distress or damage to equipment connected to the circuit. With the pre-insertion resistor, the in-rush current arising from switching back to back capacitor banks is limited to much lower values, perhaps in the range of 1.5 to 4 thousand amperes, which can be carried by the circuit without undue distress. Since the pre-insertion resistor or inductor is in the circuit only briefly during the closing of the circuit interrupting device, the pre-insertion resistor or inductor is not required to carry the continuous current of the circuit except during the portion of the insertion time after the in-rush. The vacuum devices of this type rely on complex and costly external switching techniques, while the non-vacuum devices rely on an air switch, which is quite noisy and bulky or SF6 devices, which are now creating environmental concerns due to the affect of escaped SF6 gas on the ozone layer.

Another approach to damping or limiting the current in-rush incident to the completion of the capacitor bank circuit by a high voltage switch is the continuous, permanent connection of an inductor in the circuit. However, such an arrangement does have its drawbacks since the inductor must be designed to carry continuous load currents and fault currents. In addition, there are ongoing costs associated with power losses in the inductor on a continuous basis as well as a reduction in the effectiveness of the capacitor bank to which it is connected.

Vacuum interrupters have been used with other circuit interrupting devices to provide a pre-insertion means. U.S. Pat. No. 4,383,150 illustrates a vacuum interrupter combined with an SF6 interrupter. The combination of the two interrupters results in a switching device, which is complex, costly and has the aforementioned environmental concerns associated with SF6 gas.

Prior art electronically controlled vacuum switches have allowed for precise closing on a voltage zero which minimizes the in-rush current and voltage transients as is illustrated in U.S. Pat. No. 6,921,989 B2. The electronic control employees a feedback circuit to determine the exact location and speed of the contact operating means so that the vacuum switch can be closed on a voltage zero of the sinusoidal waveform of the electric supply line. This type of vacuum switch is quite complex and costly, and can be difficult to set up when utilized in three phase applications.

Other prior art vacuum interrupters utilize multiple contact systems in an axial configuration as illustrated in U.S. Pat. Nos. 6,255,615 B1, 6,720,515 B2 and patent application US 2008/0245772 A1. These vacuum interrupters engage one set of contacts by having the contact operating means move in one direction and engage a second set of contacts when the contact operating means moves in the opposite direction. This configuration is suitable for providing a means to ground the electric circuit in which the vacuum switch or interrupter is employed, but because the contact means is not capable of engaging both sets of contacts by moving in one direction, the vacuum interrupters do not provide a pre-insertion means.

Another prior art interrupter utilizes multiple contact systems wherein one set of contacts drives another as illustrated in U.S. Pat. No. 2,863,026. In this case the operating spring for the driven contact is mounted inside the interrupter and is subject to annealing during the brazing together of the interrupter. While work hardening will result in the return of some of the spring force characteristics, its final force characteristics will be uncontrolled. Additionally, this device is not suitable as a pre-insertion device as no means is provided to precisely position the driven contact or to adjust out the tolerance accumulation between the multiple parts.

Another prior art interrupter did provide a set of load and pre-insertion contacts within the same vacuum envelope driven by a single contact rod as illustrated in U.S. Pat. No. 8,445,805. In this case, the internal stationary contact structure as well as the adjustment mechanism was rather complex and costly and the adjustment of the mechanism could be difficult.

While the aforementioned prior art arrangements may be suitable for their intended use in accordance with their respective defined applications, as discussed hereinbefore, it would be desirable to provide an efficient, economical, compact and easily adjustable pre-insertion contact arrangement contained within a vacuum switch module to limit transient in-rush currents and voltage transients.

SUMMARY OF THE INVENTION

Accordingly, it is the principal object of the present invention to provide an improved vacuum capacitor switch with pre-insertion contact activated by the motion of the main contacts and a resistor or inductor arrangement that effectively limits transient in-rush currents and/or voltages during operation of the device and does not require high energy dissipation, complex mechanical or electronic switching systems or precise insertion timing.

In the practice of the invention, the primary contact system has an annular stationary contact, which is engaged by an annular shaped moving contact. Both contacts are of copper-tungsten material, which is generally used for switching applications. The base of the stationary contact is supported between two tubular insulators, which are preferably made of ceramic and form the main portion of the interrupter housing. One of these insulators contains the first contact system. The end of this insulator is closed off by a stainless steel or monel end-cup which has an opening for the contact drive rod. The contact rod is made of copper with a stainless steel reinforcing rod to prevent a reduction in length due to repeated impact. A flexible stainless steel bellows is used to allow motion of the drive rod and allow for sealing of the end-cup. The drive rod for the moving contact disc extends through the disc and annular stationary contact into the region of the second insulator. A second moving contact disc is mounted on the end of the drive rod and is engaged by a floating contact disc mounted on a floating contact rod. These contacts are also of copper-tungsten material and the floating contact rod is also copper with a stainless steel reinforcing rod. The reinforcing rod is extended upward through the top of the floating contact rod and the extended portion is threaded to engage the mechanism described below. This contact rod is mounted on the other end of the second insulator using a bellows and end-cup arrangement to allow sealing and free motion of the floating contact. The floating contact is driven by the motion of the second moving contact, which is directly coupled to the first contact system.

A mechanism is mounted on the end-cup that supports the floating contact and allows the tolerance accumulation of the components to be adjusted out and the floating contact positioned so that the second moving contact and floating contact can close before the primary contacts. The mechanism also has the capability of controlling the range of motion of the floating contact so that it may be contacted by the second moving contact for a set time before the primary contacts close. In addition, the mechanism provides a contact pressure adjustment as well as return force during the opening stroke of the floating contact.

In order to facilitate the addition of the revised mechanism, the reinforcing rod for the floating contact was elongated so it extends well beyond the end of the contact rod and has been threaded to accept the revised adjuster components. Two studs have been brazed to the end cup of the vacuum module to facilitate mounting of an adjuster bracket using two elastic stop nuts. The adjustment of the mechanism begins with the installation of a current exchange clamp to the exposed end of the floating contact rod below the adjuster. A nut and lock washer are then loosely threaded down the reinforcing rod and the washer and compression spring placed on top. A bracket and bushing are then installed and the elastic stop nut is threaded onto the reinforcing rod. With the load contacts held closed, the pre-insertion contact gap adjustment is made by placing a gage with suitable thickness to establish the desired pre-insertion gap between the shoulder of the bushing and the top of the bracket and tightening the elastic stop nut against it. The nut and lock washer are tightened to bring the washer tight against the bottom of the bushing. This automatically sets the compression of the spring based on the length of the lower portion of the bushing extending below the bracket. This provides the contact pressure for the floating contact as well as its return force during the opening operation. During the tightening operation for both the elastic stop nut as well as the nut and lock washer, the current exchange clamp is held in place by placing shims between it and the inner walls of the bracket to keep the contact rod from rotating and damaging the bellows.

A flexible lead is attached from the current exchange clamp on one end to a suitable clamp on the other end for attachment to a pre-insertion terminal. A pre-insertion resistor or inductor of appropriate design is attached from the established pre-insertion terminal to a load terminal located on the base of the stationary contact of the primary set of contacts. A current exchange is also required for the moving contact rod for the primary set of contacts as this is a source terminal for the vacuum switch. As the primary contact rod moves to the closed position, it can be seen that the secondary contacts will close first which will allow current to flow from the source terminal connected to the primary rod, through the secondary contacts and pre-insertion resistor or inductor and out to the load terminal at the base of the stationary contact. As the primary contact rod continues its motion, the second moving contact pushes the floating contact, compressing the spring contained in the adjustment mechanism until the primary contacts engage. Once the primary contacts engage they short out the circuit, which includes the secondary contacts and pre-insertion resistor or inductor and thus effectively removes the pre-insertion resistor or inductor from the circuit. Current then flows unimpeded from the source terminal through the primary contacts to the load terminal. This motion allows the pre-insertion resistor or inductor to be momentarily connected in a capacitor bank application and then removed to allow efficient flow of the capacitor bank load current. As the moving contact rod is moved to the open position, the previously charged spring in the adjustment mechanism now discharges and forces the secondary contacts to remain engaged for a time after the primary contacts part. This reduces arcing on the primary contacts and places the pre-insertion resistor or inductor momentarily in series with the capacitor bank to reduce transients when the secondary contacts break the circuit. The invention described above is suitable for use in oil or SF6 switchgear.

A ramification of the invention allows the vacuum switch to be encapsulated. This is facilitated by the addition of a housing, which prevents the encapsulation material from contacting the moving components of the threaded adjuster. The housing includes a metallic cylinder with a top made of insulating material. The portions of the housing are held in place by screws, which engage insulators, which are secured to studs, which are brazed to the end-cup of the interrupter. A flexible lead transfers current from the floating contact rod to a terminal, which exists out the top of the housing. A terminal rod is extended out from the stationary contact and a current exchange utilizing a multi-lam construction and bellows anti-twist means is utilized with the primary moving contact. A terminal rod is extended out from this current exchange, in the opposite direction to that on the stationary contact to maximize terminal dielectric clearances. This configuration may be encapsulated using the various techniques established in prior art. Once encapsulated, the pre-insertion resistor or inductor may be mounted externally between the top terminal and the terminal connected to the stationary contact.

DESCRIPTION OF THE PREFERRED EMBODIMENTS

Figures 1, 1A:
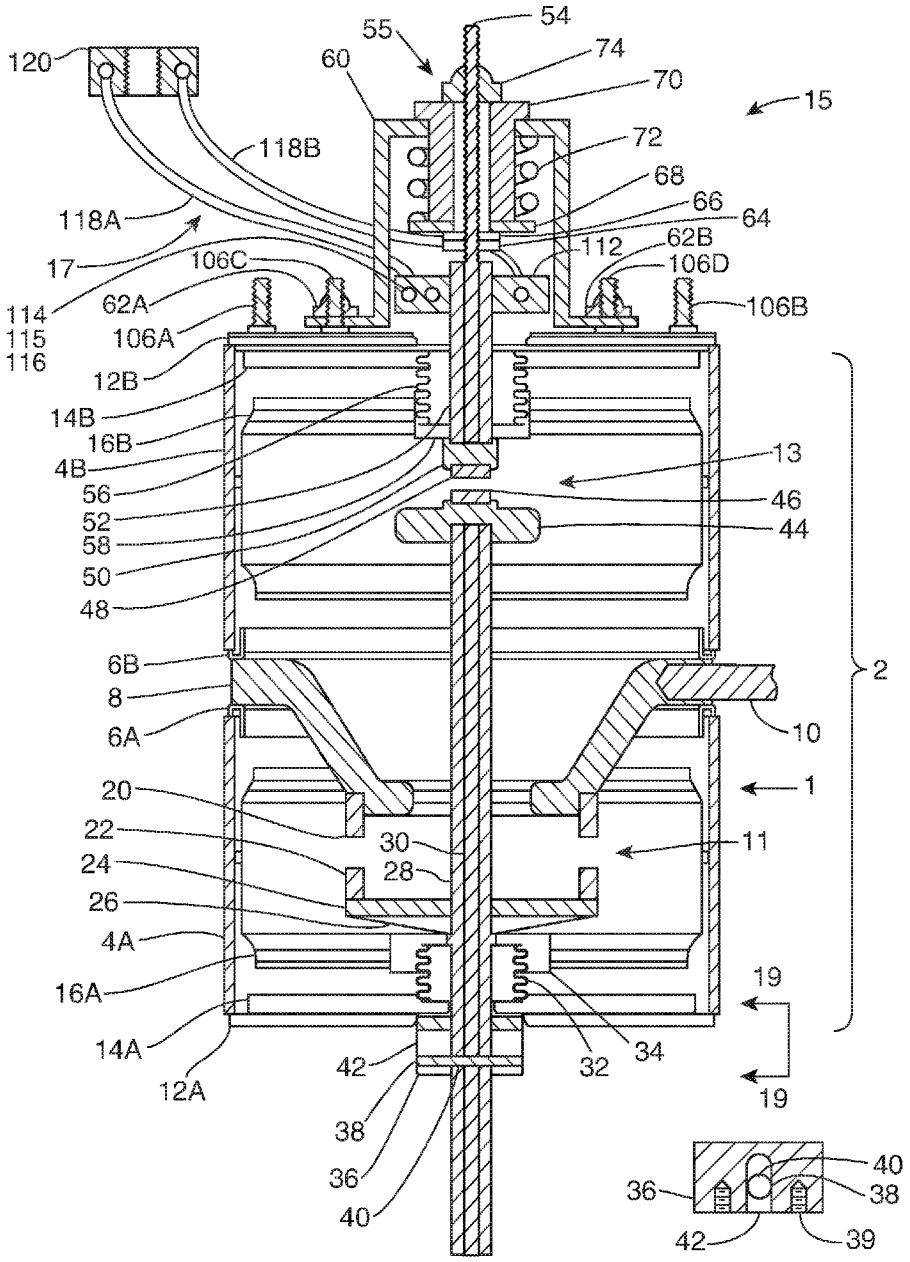
FIG. 1 is a cross-sectional view of a vacuum switch with pre-insertion contact including a vacuum envelope in accordance with the present invention.
FIG. 1*a* is an enlarged cross-sectional side view of a bellows anti-twist housing of a vacuum switch with pre-insertion contact in accordance with the present invention.

FIG. 1 discloses a vacuum capacitor switch with pre-insertion contact (vacuum switch) 1. The vacuum switch 1 includes a vacuum envelope 2. The major part of the vacuum envelope 2 includes a pair of insulating cylinders 4A and 4B preferably fabricated from alumina ceramic and joined end-to-end by way of two stainless steel or monel triple point shields 6A and 6B and a stationary contact support 8 preferably fabricated from copper. A threaded hole in the stationary contact support 8 allows the attachment of a terminal rod 10 preferably fabricated from copper to facilitate electrical connection to the load line. The opposite ends of the ceramic cylinders are enclosed by two end cups 12A and 12B preferably fabricated from stainless steel or monel.

A second set of triple point shields 14A and 14B preferably fabricated from stainless steel or monel are attached to the end cups 12A and 12B. A generally tubular set of internal vapor shields 16A and 16B preferably fabricated from stainless steel or monel is provided within each insulating cylinder 4A and 4B spaced from the interior wall and overlapping the triple point shields 14A and 14B to prevent any vaporized material from contacting the interior wall.

A primary contact system 11 includes a generally bowl shaped stationary contact support 8 preferably fabricated from copper. An annular stationary contact 20 preferably fabricated from copper tungsten is attached to a lower end of the stationary contact support 8 at the outside diameter at the bottom of the bowl shape. This allows the inclined sides of the side of the bowl to provide rigidity to the contact structure, while the portion of the bottom of the bowl that extends inward to form a circular opening for the passage of the moving contact rod 28 described below and to provide reduction of the chance of contact vapors produced during arc interruption from migrating from the second contact system 13 to the primary contact system 11 and possibly resulting in a restrike of the arc. The annular stationary contact 20 is engaged with an annular moving contact 22, which is also preferably fabricated from copper tungsten.

The annular moving contact 22 is attached to a disc shaped moving contact support 24 preferably fabricated from copper. The moving contact support 24 is reinforced by a moving contact reinforcement cone 26 preferably fabricated from stainless steel. Both the moving contact support 24 and the moving contact reinforcement cone 26 are retained on a moving contact rod 28 preferably fabricated from copper. The moving contact rod 28 is reinforced by a reinforcing rod 30 preferably fabricated from stainless steel and is sealingly passed through the end cup 12A and the triple point shield 14A by a bellows 32 to allow electrical connection to the source line. The bellows 32 is preferably fabricated from stainless steel. The bellows 32 is preferably protected from vaporized material damage by a bellows shield 34. The bellows shield 34 is preferably fabricated from stainless steel.

A bellows anti-twist housing 36 preferably fabricated from stainless steel is attached to the opposite side of end cup 12A and is centered by a circular depression formed in the end cup 12A. With reference to FIG. 1*a*, the bellows anti-twist housing 36 is indexed to the moving contact rod 28 by a hardened pin 38 preferably fabricated from nickel plated steel, which passes through a cross-hole 40 in the moving contact rod 28 and slides in a slot 42 in the bellows anti-twist housing 36. Two threaded holes 39 are formed in the bellows anti-twist housing 36 to facilitate attachment of a current exchange housing 126.

Figure 2:
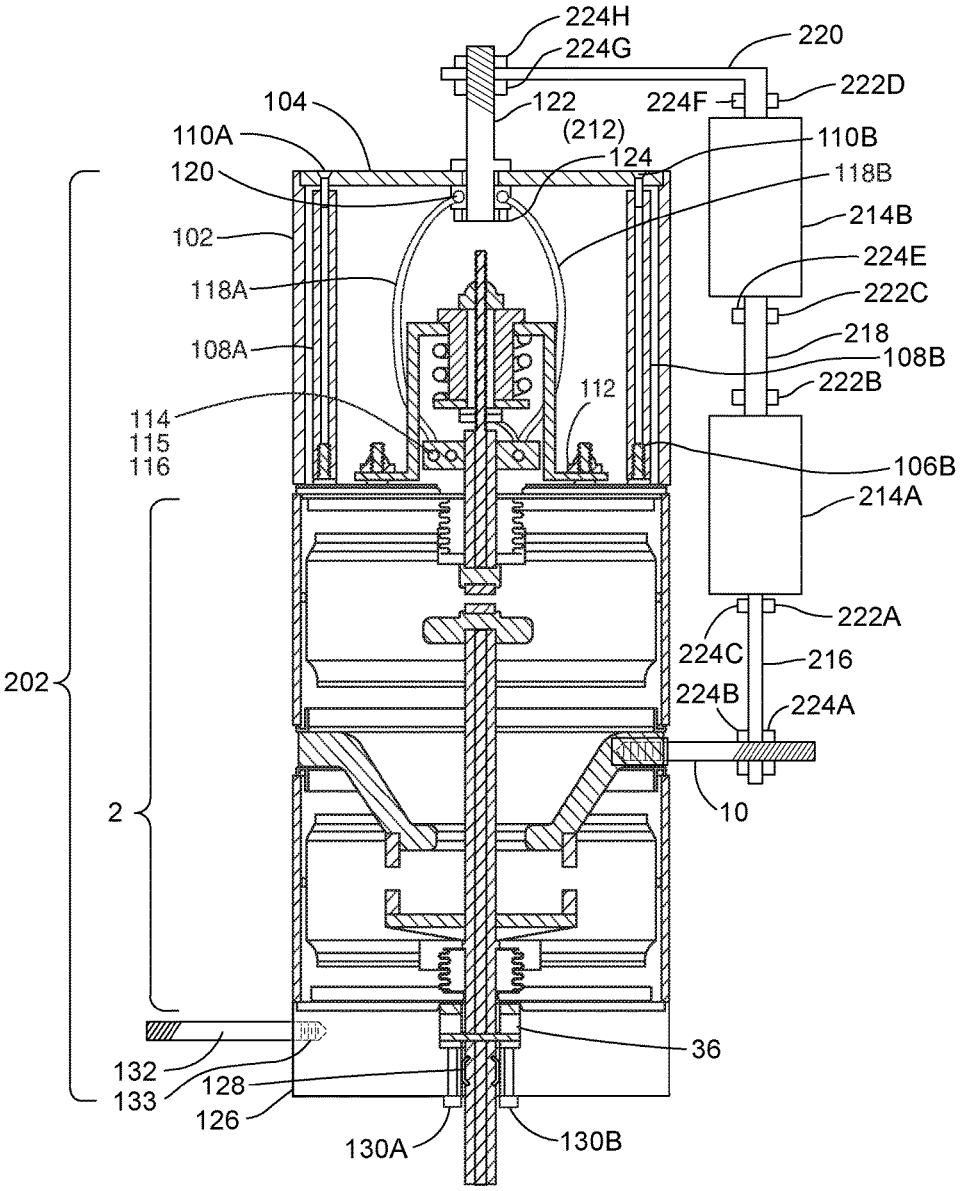
FIG. 2 is a cross-sectional view of a vacuum switch with pre-insertion contact prepared for encapsulation in accordance with the present invention.

A second contact system 13 includes the extension of the moving contact rod 28, which passes through the moving contact support 24. A disc shaped moving contact support 44 preferably fabricated from copper is attached to an end of the moving contact rod 28. The lower portion of the outside diameter of the moving contact support 44 is extended outward to deflect contact vapors produced during the arc interruption outward toward the internal vapor shield 16B. This is done to work in conjunction with positioning of the stationary contact 20 on the stationary contact support 8 described previously to reduce the chance of the contact vapors from migrating from the second contact system 13 to the primary contact system 11. A disc shaped moving contact 46 preferably fabricated from copper tungsten is attached to the moving contact support 44. The second contact system 13 further includes a disc shaped floating contact 48 preferably fabricated from copper tungsten, which is attached to an end of a disc-shaped floating contact support 50 preferably fabricated from copper. The floating contact support 50 is attached to a floating contact rod 52 preferably fabricated from copper, which is reinforced by a reinforcing rod 54 preferably fabricated from stainless steel and sealingly passed through the end cup 12B and triple point shield 14B by a bellows 56. The reinforcing rod 54 is extended upward through the top of the floating contact rod 52 and the extended portion is threaded to engage the mechanism 15 described below. Bellows 56 is protected from damage by vaporized material by a bellows shield 58. The bellows 56 and the bellows shield 58 are preferably fabricated from stainless steel. Four studs 106A-D preferably fabricated from stainless steel are attached to the top of end-cup 12B to facilitate the mounting of mechanism 15 as well as the cover for the mechanism required if the module 1 is encapsulated (FIG. 2). At this point the module 1 is ready to undergo the brazing operation, which establishes the internal vacuum and attaches and seals the aforementioned parts.

Upon completion of the brazing of the vacuum module, the operating mechanism 15 for the floating contact structure may be installed. A terminal assembly 17 is preferably made up of a split-clamp connector 112 preferably fabricated from copper with a pair of highly flexible multi-stranded conductors 118A and 118B preferably fabricated from copper conductively secured to the split clamp connector 112 on one end and to a terminal connector 120 preferably fabricated from copper on the other end thereof. This configuration is suitable for encapsulation of the vacuum module as described below, but may be altered as needed if the vacuum module is applied in oil or SF6. The split-clamp connector is loosely installed on the exposed end of the floating contact rod 52. A nut 64 and a split lock washer 66 are both preferably fabricated from nickel or tin plated steel and are loosely threaded down onto the exposed threaded end of reinforcing rod 54 to be in close proximity to the end of the floating contact rod 52. A washer 68 and compression spring 72 are then slid down the reinforcing rod 54 against lock washer 66. A bracket 60 preferably fabricated from nickel or tin plated steel is assembled to studs 106C and 106D and fixed in place with elastic stop-nuts 62A and 62B. The split-clamp connector 112 is designed so that it fits inside the inside walls of bracket 60 with a preferable gap of 0.032 inch on each side to allow free vertical movement of the clamp within the bracket. Suitable shims (not shown) are placed between each side of the split-clamp 112 and the inner walls of bracket 60 to hold the clamp square with the bracket and bolt 114, lock washer 115 and nut 116 all preferably made of phosphor bronze are tightened to secure the clamp to the end of the floating contact rod 52. The bushing 70 is then inserted down reinforcing rod 54 through the top of the bracket 60 and down the center of compression spring 72. Nut 64 is then loosely threaded up reinforcing rod 54 until the compression spring 72 contacts an underside of the bracket 60.

During the adjustment of mechanism 15, both the first and second set of contacts 11, 13 must be closed. A 0.156 thick gage (not shown) is placed under the shoulder of bushing 70 in contact with the top surface of bracket 60. Elastic stop nut 74 is threaded onto reinforcing rod 54 to the point where it just touches a top of the shoulder bushing 70. During adjustment of mechanism 15, the shims used to install the split-clamp 112 are left in place to prevent any twisting of the bellows 48. Nut 64 is now tightened to bring washer 68 up tight against the bottom of bushing 70, compressing spring 72. A length of the shoulder bushing 70 extending below a bottom surface of bracket 60 is designed to compress the spring 72 to the point resulting in a spring force of preferably 35 pounds. This not only supplies the contact pressure when the second contact system 13 engages, but also supplies the return force for floating contact 48 during the contact opening stroke. A threaded adjuster 55 preferably includes the nut 64, the split lock washer 66, the washer 68, the bushing 70, the compression spring 72 and the elastic stop nut 74. The threaded adjuster 55 is retained by the bracket 60.

With the first and second set of contacts open, the 0.156 inch thick adjustment gage as well as the two shims are removed. This allows the floating contact rod 52 to be driven downward 0.156 inch until the shoulder of bushing 70 contacts the top of bracket 60. In this way it will be seen that upon closing the contacts, the second system of contacts 13 will close in advance of the first set of contacts 11. The selection of the 0.156 gage thickness is based on the typical closing speed of a vacuum switch or interrupter of 3 feet per second and at that speed results in the second contact system closing ¼ cycle before the first contact system based on a 60 cycle waveform.

While the aforementioned module may be applied as is in oil or SF6 insulated switchgear, most modern switchgear is currently encapsulated to provide reduced size and maintenance requirements. In order to facilitate encapsulation of an end of the vacuum capacitor switch 1; a cover housing 102 and cover plate 104 are placed over the adjustment mechanism 15 as shown in FIG. 2. The cover housing 102 is preferably fabricated from an aluminum material. The cover plate 104 is preferably fabricated from an insulating material such as GP01 or GP03 fiberglass or G10 epoxy glass.

An insulating support post 108A and 108B preferably fabricated from a filament wound epoxy glass is threaded onto each stud 106A and 106B (described previously). A screw 110A and 110B preferably fabricated from stainless steel is threaded into an opposite end of each stringer 108A and 108B to retain the cover plate 104 and the cover housing 102. The terminal connector 120 (part of the terminal assembly 17 described previously) is preferably threaded onto the lower portion of a pre-insertion terminal 122 and secured with a jam nut 124; creating a current exchange between the floating contact rod 52 and the pre-insertion terminal 122. The pre-insertion terminal 122 is preferably fabricated from copper and the jam nut 124 from brass.

The opposite end of the vacuum switch 1 is prepared for encapsulation by installation of the current exchange housing 126 preferably fabricated from copper and a multi-lam contact 128. The current exchange housing 126 is placed over the bellows anti-twist housing 36. The multi-lam contact 128 provides electrical contact between the moving contact rod 28 and the current exchange housing 126. The current exchange housing 126 is secured to the bellows anti-twisting housing 36 with a pair of bolts 130A and 130B preferably fabricated from stainless steel. A threaded hole 133 in a perimeter of the current exchange housing 126 allows the attachment of a terminal rod 132 preferably fabricated from copper to facilitate electrical connection to a source line.

Figure 3:
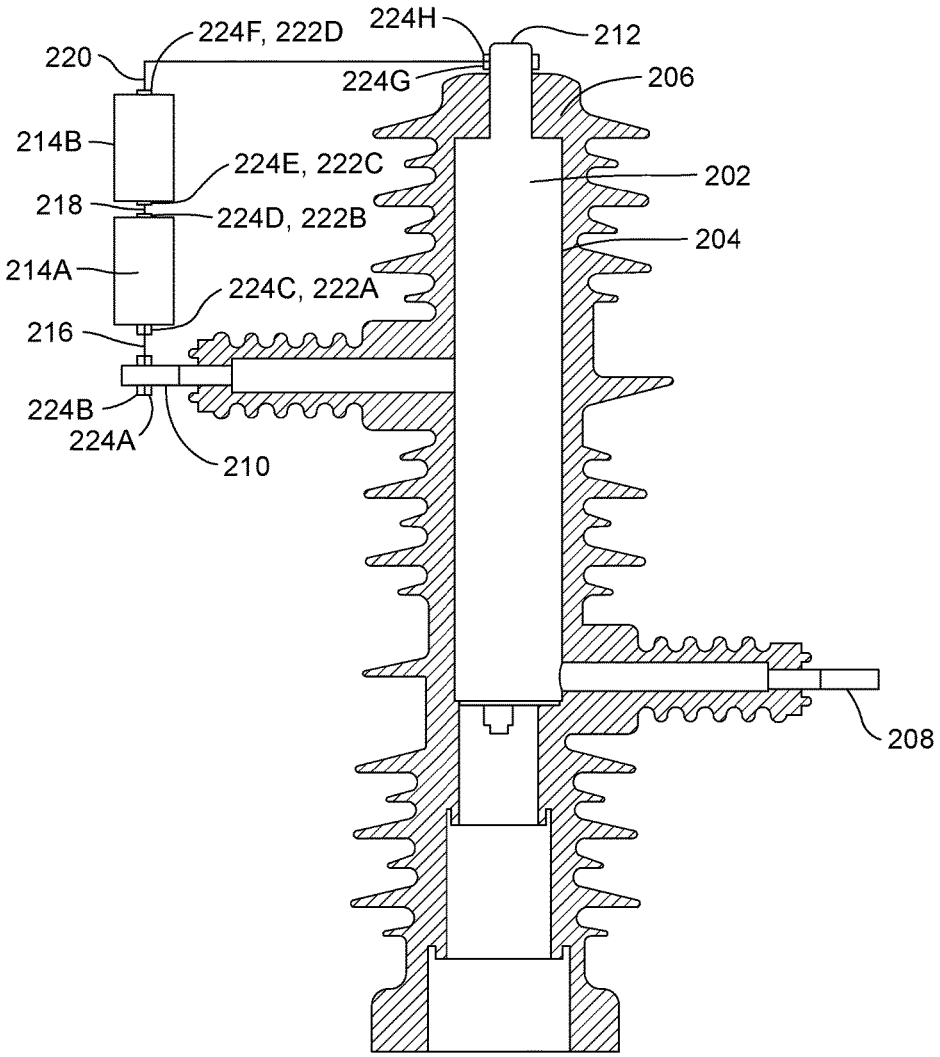
FIG. 3 is a cross-sectional view of a method of encapsulating a vacuum switch with pre-insertion contact in accordance with the present invention.

There are several examples of prior art patents, which show the encapsulation of vacuum modules. FIG. 3 indicates one possible way of encapsulating the aforementioned vacuum switch as demonstrated by U.S. Pat. No. 5,917,167. In this case, a substantial portion of the invention 202 is encased in a tube 204 and cast in an encapsulation 206. The tube 204 is preferably a silicone rubber and the encapsulation is preferably an epoxy. The result is a three terminal encapsulation with a source terminal 208, a load terminal 210 and a pre-insertion terminal 212. A pair of pre-insertion resistors or inductors 214A and 214B are connected from the pre-insertion terminal 212 to the load terminal 210 utilizing [stainless steel] brackets 216, 218 and 220, [tin plated phosphor bronze] bolts 222A-D and [tin plated phosphor bronze] nuts 224A-H. The brackets 216-220 are preferably stainless steel. The bolts 222A-D and nuts 224A-H are preferably fabricated from tin plated phosphor bronze. This places the pre-insertion components electrically in series with the aforementioned second contact system and this series combination electrically in parallel with the first contact system.

In operation, the aforementioned encapsulated vacuum capacitor switch would be coupled via an operating rod with contact pressure spring device to an operating mechanism (neither item shown). The closing stroke of the operating mechanism and operating rod would drive the moving contact rod 28 upward. Because of the aforementioned adjustment of the adjustment mechanism 15, the compression spring 72 causes the floating contact rod 52 to be pushed downward. This causes the second set of contacts to engage in advance of the first set of contacts by the preferable dimension of 156 inch (created by the gauged adjustment). Once the second set of contacts 46 and 48 engage, electric current flows from the source terminal 208, through the second set of contacts 13 and through the pre-insertion resistors or inductors and out the load terminal 210. As the moving contact rod 28 continues its closing stroke, the floating contact rod 52 is driven upward resulting in the nut 64, washer 68 and bushing 70 moving upward and the compression spring 72. The closing stroke is completed; when moving contact rod 28 is driven to the point that the first set of contacts 20 and 22 make. At this point, the electric current flows from the source terminal 208 through the first set of contacts and directly out the load terminal 210, bypassing the second set of contacts and the pre-insertion resistors or inductors 214A, 214B. The operation results in the pre-insertion resistors or inductors 214A, 214B being in the circuit for approximately ¼ cycle of the 60 cycle wave. During this time, the in-rush current experienced during energizing of parallel bank capacitors (not shown) would be damped.

Upon initiation of the opening stroke, the moving contact rod 28 moves downward causing the first set of contacts 20 and 22 to immediately part. However, the energy stored in the spring 72 forces the floating contact rod 52 downward maintaining contact through the second set of contacts 46 and 48. This re-establishes current flow through the pre-insertion resistors or inductors and results in an essentially arc-less parting of the first set of contacts. As moving contact rod 28 continues its opening stroke, the floating contact rod 52 continues to move downward, until the shoulder of bushing 70 contacts the top of the bracket 60. At this point, floating contact rod 52 is no longer able to follow the contact rod 28 downward and the second set of contacts 46 and 48 begins to part initiating an arc. With the pre-insertion resistors or inductors now back in series with the circuit the transient recovery voltage transient is damped resulting in an efficient interruption of the arc as the moving contact rod 28 completes its opening stroke and provides the full open gap for the second set of contacts.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A vacuum capacitor switch with a pre-insertion contact, comprising:

a vacuum enclosure;

a first contact system includes a moving contact and a stationary contact structure, said stationary contact structure includes a stationary contact support and a stationary contact, said stationary contact support includes a substantial bowl shaped cross section with angled side walls, said stationary contact extends from a bottom of said stationary contact support, said stationary contact structure is retained inside said vacuum enclosure at substantially at one end thereof, said angled side walls form an acute angle with a lengthwise axis of said vacuum enclosure; and a second contact system includes a moving contact rod, a floating contact rod and a biasing device, said floating contact rod is retained at the other one end of said vacuum enclosure, said biasing device is retained on the other end of said vacuum enclosure, substantially one end of said floating contact rod is retained by said biasing device, the other end of said floating contact rod is biased toward the one end of said vacuum enclosure, said moving contact is retained on said moving contact rod, said biasing device includes a bracket and a threaded adjuster, said bracket is secured to said vacuum enclosure, said threaded adjuster is retained by said bracket, said floating contact rod is threadably engaged with said threaded adjuster, said floating contact rod is axially adjustable relative to said bracket, wherein a load is electrically connected between said stationary contact and said floating rod.

2. The vacuum capacitor switch with pre-insertion contact of claim 1 wherein:

said vacuum switch is encapsulated in a solid dielectric insulation.

3. The vacuum capacitor switch with pre-insertion contact of claim 1 wherein:

said moving contact having an annular moving contact pad, said stationary contact being an annular stationary contact pad.

4. The vacuum capacitor switch with pre-insertion contact of claim 1, further comprising:

a floating contact pad is retained on an end of said floating contact rod, a moving contact pad is retained on an end of said moving contact rod.

5. The vacuum capacitor switch with pre-insertion contact of claim 1 wherein:

said threaded adjuster includes a bushing, a compression spring, a first nut and a second nut, wherein said bushing is retained in said bracket, said compression spring is retained on said bushing, said first nut is threaded on to said floating contact rod, said floating contact rod is inserted through said bushing, said second nut is threaded on to said floating contact rod.

6. The vacuum capacitor switch with pre-insertion contact of claim 1, further comprising:

a moving contact support includes an extended outer diameter to deflect contact vapors produced during arcing, said moving contact support is attached to an end of said moving contact rod, a disc shaped moving contact is attached to a top of said moving contact support.

7. A vacuum capacitor switch with pre-insertion contact, comprising:

a vacuum enclosure;

a first contact system includes a moving contact and a stationary contact, said stationary contact is retained inside said vacuum enclosure at substantially one end thereof; and a second contact system includes a moving contact rod, a floating contact rod and a biasing device, said floating contact rod is retained at the other end of said vacuum enclosure, said biasing device is retained on the other end of said vacuum enclosure, substantially one end of said floating contact rod is retained by said biasing device, the other end of said floating contact rod is biased toward the one end of said vacuum enclosure, said moving contact is retained on said moving contact rod, a distance that said floating contact rod extends from said biasing device is adjustable, said biasing device includes a bracket and a threaded adjuster, said bracket is secured to said vacuum enclosure, said threaded adjuster includes a bushing, a compression spring, a first nut and a second nut, wherein said bushing is retained in said bracket, said compression spring is retained on said bushing, said first nut is threaded on to said floating contact rod, said floating contact rod is inserted through said bushing, said second nut is threaded on to said floating contact rod, said floating contact rod is threadably engaged with said threaded adjuster, said floating contact rod is axially adjustable relative to said bracket, wherein a load is electrically connected between said stationary contact and said floating rod.

8. The vacuum capacitor switch with pre-insertion contact of claim 7, further comprising:

said vacuum switch is encapsulated in a solid dielectric insulation.

9. The vacuum capacitor switch with pre-insertion contact of claim 7, further comprising:

said moving contact having an annular moving contact pad, said stationary contact having an annular shape, said stationary contact having an annular stationary contact pad.

10. The vacuum capacitor switch with pre-insertion contact of claim 7, further comprising:

a floating contact pad is retained on an end of said floating contact rod, a moving contact pad is retained on an end of said moving contact rod.

11. The vacuum capacitor switch with pre-insertion contact of claim 7, further comprising:

said threaded adjuster is retained by said bracket.

12. The vacuum capacitor switch with pre-insertion contact of claim 7, further comprising:

a stationary contact support includes a cross section having a generally bowl shape for deflecting contact vapors produced during arcing, an annular stationary contact is attached to a bottom end of said stationary contact support.

13. The vacuum capacitor switch with pre-insertion contact of claim 7, further comprising:

a moving contact support includes an extended outer diameter to deflect contact vapors produced during arcing, said moving contact support is attached to an end of said moving contact rod, a disc shaped moving contact is attached to a top of said moving contact support.

14. A vacuum capacitor switch with pre-insertion contact, comprising:

a vacuum enclosure;

a first contact system includes a moving contact and a stationary contact structure, said stationary contact structure includes a stationary contact support and a stationary contact, said stationary contact support includes a substantial bowl shaped cross section with angled side walls, said stationary contact extends from a bottom of said stationary contact support, said stationary contact structure is retained inside said vacuum enclosure at substantially at one end thereof; and a second contact system includes a moving contact rod, a floating contact rod and a biasing device, said floating contact rod is retained at the other end of said vacuum enclosure, said biasing device is retained on the other end of said vacuum enclosure, substantially one end of said floating contact rod is retained by said biasing device, the other end of said floating contact rod is biased toward the one end of said vacuum enclosure, said moving contact is retained on said moving contact rod, said biasing device includes a bracket and a threaded adjuster, said bracket is secured to said vacuum enclosure, said threaded adjuster includes a bushing, a compression spring, a first nut and a second nut, wherein said bushing is retained in said bracket, said compression spring is retained on said bushing, said first nut is threaded on to said floating contact rod, said floating contact rod is inserted through said bushing, said second nut is threaded on to said floating contact rod, said floating contact rod is threadably engaged with said threaded adjuster, said floating contact rod is axially adjustable relative to said bracket, wherein a load is electrically connected between said stationary contact and said floating rod.

15. The vacuum capacitor switch with pre-insertion contact of claim 14, further comprising:

said moving contact having an annular moving contact pad, said stationary contact being an annular stationary contact pad.

16. The vacuum capacitor switch with pre-insertion contact of claim 14, further comprising:

a floating contact pad is retained on an end of said floating contact rod, a moving contact pad is retained on an end of said moving contact rod.

17. The vacuum capacitor switch with pre-insertion contact of claim 14, further comprising:

said threaded adjuster is retained by said bracket.

18. The vacuum capacitor switch with pre-insertion contact of claim 14, further comprising:

a stationary contact support includes a cross section having a generally bowl shape for deflecting contact vapors produced during arcing, an annular stationary contact is attached to a bottom end of said stationary contact support.

19. The vacuum capacitor switch with pre-insertion contact of claim 14, further comprising:

a moving contact support includes an extended outer diameter to deflect contact vapors produced during arcing, said moving contact support is attached to an end of said moving contact rod, a disc shaped moving contact is attached to a top of said moving contact support.

* * * * *